United States Patent [19]

Reist

[11] Patent Number: 4,750,725

[45] Date of Patent: Jun. 14, 1988

[54] PRINTED PRODUCTS HAVING A CENTER FOLD AND CONTAINING A PRODUCT BREAK STRUCTURE, AND METHOD AND APPARATUS FOR OPENING SUCH PRINTED PRODUCTS

[75] Inventor: Walter Reist, Hinwil, Switzerland

[73] Assignee: Ferag AG, Hinwil, Switzerland

[21] Appl. No.: 880,578

[22] Filed: Jun. 30, 1986

[30] Foreign Application Priority Data

Jul. 12, 1985 [CH] Switzerland ..... 3023/85

[51] Int. Cl.[4] ..... B42C 1/00

[52] U.S. Cl. ..... 270/45; 493/397; 493/923

[58] Field of Search ..... 270/20.1–21.1, 270/45, 52.5, 55, 57; 493/339, 324, 212, 231, 267, 186, 189, 916, 964, 923, 968, 58–59, 228, 240, 243, 246, 199, 309–311, 340, 355, 465, 397, 352–353, 356, 377, 363–365; 206/491, 494, 601, 625; 53/412, 457, 381 R; 229/76

[56] References Cited

U.S. PATENT DOCUMENTS

| | | | |
|---|---|---|---|
| 466,032 | 12/1891 | Fleming | 229/76 |
| 2,176,815 | 10/1939 | Harohashi | 493/353 |
| 3,152,501 | 10/1964 | Nassar | 493/363 |
| 3,228,710 | 1/1966 | Chodorowski | 270/45 |
| 3,692,301 | 9/1972 | Wetter | 270/55 |
| 3,843,113 | 10/1974 | Schaffer | 493/397 |
| 4,261,253 | 4/1981 | Smith, II | 493/212 |
| 4,539,793 | 9/1985 | Malek | 493/189 |
| 4,559,259 | 12/1985 | Cetrelli | 493/59 |

FOREIGN PATENT DOCUMENTS

| | | | |
|---|---|---|---|
| 358444 | 11/1961 | Switzerland | 270/57 |
| 461547 | 8/1968 | Switzerland . | |
| 521911 | 4/1972 | Switzerland . | |
| 610290 | 11/1948 | United Kingdom . | |

*Primary Examiner*—E. H. Eickholt

*Attorney, Agent, or Firm*—Werner W. Kleeman

[57] ABSTRACT

Printed products having a center fold are provided with appropriate product break structure for facilitating opening of the printed products. Such product break structure comprises a crimp structure which may be in the form of impressions or embossments. This crimp structure is provided in the region of one end of the center fold of the printed products to be opened. These crimp structures mutually converge in relation to one another and extend to a common point located on the center fold of the printed products. Each of the printed products can be opened at the center fold by applying or exerting pressure on the folded edge or spine of the printed products at the end of the center fold which is provided with the crimp structure. An opening element can enter the opening thus formed for separating the two halves of each of the printed products.

2 Claims, 1 Drawing Sheet

Fig.1
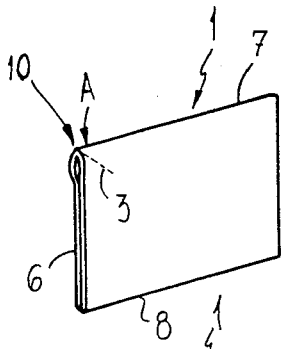
Fig.3
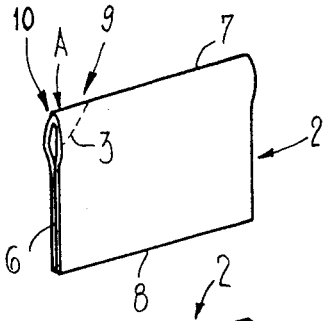
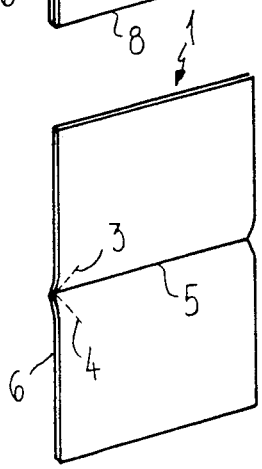
Fig.2
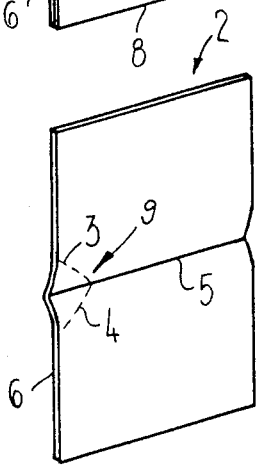
Fig.4

PRINTED PRODUCTS HAVING A CENTER FOLD AND CONTAINING A PRODUCT BREAK STRUCTURE, AND METHOD AND APPARATUS FOR OPENING SUCH PRINTED PRODUCTS

BACKGROUND OF THE INVENTION

The present invention broadly relates to a new and improved method and apparatus for opening printed products having a center fold and provided with a unique product break or opening structure and also pertains to an improved construction of such printed products.

Generally speaking, the present invention relates to a new and improved method for opening printed products having a center fold by applying pressure to one end of the folded edge or spine of the printed product, wherein the resulting opening of the printed product is intended to facilitate entry of an end of an opening element or member for opening of the printed product.

A method of the aforementioned general type for the mechanical insertion of supplements into folded printed products, such as printed magazines or booklets having a center fold is known from the Swiss Patent No. 358,444, published Jan. 15, 1962. In order to open the printed products, however, a substantial expenditure of mechanical work is necessary. The printed products rest with their folded edges or spines on a conveyor belt. These printed products are held in an upright position on both sides by means of two guide rails during their transportation or conveyance. Immediately prior to a printed product arriving in front of an opening wedge, the printed product is gripped from both sides by contact or press rollers which allow the printed product to pass in the direction of conveyance, but which prevent an upward displacement of the printed product. A pressure or force applied from below is then exerted by means of a cam plate upon the front lower edge of the printed product, thus producing an opening in the region of the center fold of such printed product. Upon further or continued transport of the printed product, an opening wedge enters into the aforesaid opening in the printed product.

SUMMARY OF THE INVENTION

Therefore, with the foregoing in mind, it is a primary object of the present invention to provide a new and improved method and apparatus for opening printed products having a center fold, including a new and improved construction of the printed products themselves, and which method, apparatus and products afford an easier and better defined opening of the printed products with less expenditure of work.

Another and more specific object of the present invention aims at providing a new and improved method and apparatus of the previously mentioned type which reduces to an absolute minimum the mechanical work expended for opening the printed products and, simultaneously, increases the reliability of opening the printed products.

In keeping with the preceding object, the method according to the invention permits an extension of the basic task of opening multiple-paged printed products in the form of newspapers without the necessity of the printed products having to possess any conventional marginal lap which, in turn, results in a substantial reduction of waste paper whose value, at least in printing plants for magazines or newspapers, will result in substantial economy.

Now in order to implement these and still further objects of the invention, which will become more readily apparent as the description proceeds, the method of the present invention is manifested by the features that each printed product is provided with a product break structure. This product break or product opening facilitating structure comprises a crimp structure. This crimp structure may be in the form of impressions or embossments formed on each of the printed products in the region of at least one predetermined end of the center fold of each such printed product. Each of these crimp structures substantially converge in relation to one another at least approximately near to the region of the product center fold and are oriented substantially towards a common point on the center fold. The exertion of pressure for product opening is oriented along a predetermined line of force which extends at an inclination to the associated crimp structure.

Furthermore, the apparatus of the present invention is manifested by the features that folding means are provided for forming a product center fold. Additionally, crimping means are provided for forming crimping structures in the printed products, such as impressions or embossments. These crimping means are arranged subsequent to the folding means.

Moreover, the printed products of the present invention are manifested by the features that the printed products comprise product halves which are folded upon one another. The innermost pages of the two product halves comprise crimp structures at least in the region of one end of the center fold of the printed products. These crimp structures extend at least approximately until the region of or rear to this center fold and are oriented substantially towards a common point or location of the center fold.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein:

FIG. 1 is a perspective view of a closed printed product in the shape of a tabloid upon which pressure already is being exerted;

FIG. 2 is a perspective view of the printed product shown in FIG. 1 which already is completely opened;

FIG. 3 is a perspective view of a further embodiment of a closed printed product in the shape of a tabloid upon which pressure already is being exerted; and FIG. 4 is a perspective view of the printed product shown in FIG. 3 which already is completely open.

DETAILED DESCRIPTION OF THE PREFERRED EMBODIMENTS

Describing now the drawings, it is to be understood that to simplify the showing thereof only enough of the structure of the printed products having a center fold has been illustrated therein as is needed to enable one skilled in the art to readily understand the underlying principles and concepts of this invention. Turning now specifically to FIGS. 1 and 2 of the drawings showing a first exemplary embodiment, the printed product 1 illustrated therein by way of example and not limitation and employed to realize the method as described hereinbelow, will be seen to comprise product break structure or product opening facilitating structure in the form of the crimp structures or crimp means 3 and 4. These crimp structures or crimp means 3 and 4 converge towards the associated end of a fold which may be a center fold 5 or a basically equivalent slightly eccentric fold, i.e. towards a lateral or side edge 6 of the related printed product 1.

According to the modified embodiment of FIGS. 3 and 4, on the other hand, the printed product 2 shown therein likewise comprises crimp structures or crimps means 3 and 4. These crimp structures or crimp means 3 and 4, however, converge in the opposite or reverse direction than the crimp structures or crimp means 3 and 4 illustrated in FIGS. 1 and 2, that is to say away from the lateral or side edge 6.

In reference to FIGS. 1 and 2, the crimp structures or crimp means 3 and 4 reach and contact the center fold 5 at the region of the lateral or side edge 6. Due to these measures, i.e. the forming of the crimp structures or crimp means 3 and 4, the printed products 1 and 2 open at the center fold 5, simply upon exertion of a pressure, as generally indicated by the arrow A, and which pressure is applied at the end of the product folded edge or spine 7 provided with the crimp structures or crimp means 3 and 4 as is shown in FIGS. 1 and 3. It is not necessary to support the printed products 1 and 2 in the regions of their side or lateral edges 6 against the exertion of the pressure A. The printed products 1 and 2 naturally must be held or supported in some convenient manner. How this is accomplished, however, is not important. If the printed products 1 and 2 are held or supported in the regions of the center fold 5 or folded edge 7, they can then be deposited without problems onto a not particularly shown collecting device or rail or the like after complete opening of the printed products. That is to say, the printed products 1 and 2 can be suspended as shown in reference to FIGS. 1 and 3 with an open side edge or fan edge hanging downward, i.e. with their open side edge or fan edge 8 located opposite to the folded edge or fold 7, hanging downward.

If the crimp structures or crimp means 3 and 4 extend, as illustrated in FIGS. 3 and 4, so that they reach or contact the center fold 5 at a predetermined distance from the lateral or side edge 6, these crimp structures or crimp means 3 and 4 form a predetermined product bending or breaking point or structure 9. Such a product breaking point or structure 9, moreover, not only defines a predetermined location of bending or breaking for the side edges 6, but also for the center fold 5 in that the end of the folded edge 7 can break or bend at the intersection or common point of the crimp structures or crimp means 3 and 4. If, however, the crimp structures or crimp means 3 and 4 are oriented in the opposite or reverse direction as is shown in FIGS. 1 and 2, they then prevent the associated corner of the printed product 1, upon which pressure A is being exerted, from being laterally deflected toward the one or toward the other side when this pressure A is exerted. Neither of the crimp structures or crimp means 3 and 4, however, resist the downward yielding of the folded edge 7. Thus, the exertion of the pressure A leads with a high degree of reliability to an opening of the product at the region of the center fold 5, irrespective of the fact whether the printed products 1 and 2 comprise a single, a few, or a large number of double sheets.

In order to form the crimp structures or crimp means 3 and 4 at the printed products 1 and 2, according to the invention suitably designed crimping means or crimping implements are provided on a printing machine. The location of these crimping means or implements is governed by the necessity of forming the crimp structures or crimp means 3 and 4 before folding the printed products 1 and 2. In other words, the crimping means or implements are arranged prior to or upstream of the product folding means. The crimp structures or crimp means 3 and 4 can be formed as impressions which present mutually confronting concave sides to the interior or inwardly of the folded printed product or, conversely, as embossments which present mutually confronting convex sides to the interior of the folded printed product.

While there are shown and described present preferred embodiments of the invention, it is to be distinctly understood that the invention is not limited thereto, but may be otherwise variously embodied and practiced within the scope of the following claims. Accordingly,

What I claim is:

1. A method for opening a printed product possessing a predetermined folded edge, comprising the steps of:

impressing upon the printed product a product break structure in the region of a predetermined end of the predetermined folded edge such that said product break structure converges toward the predetermined folded edge;

exerting pressure on said predetermined folded edge in said predetermined end region of said predetermined folded edge and in a manner such that a predetermined line of force, which is defined by exerting said pressure, and said product break structure extend at a predetermined inclination relative to each other, in order to the produce an opening in said folded printed product;

inserting a predetermined end of an opening element into the opening produced as a result of the step of applying said pressure to said predetermined end region of said predetermined folded edge of said printed product;

said product break structure comprises at least one crimp structure; and said step of impressing said product break structure entails forming said crimp structure such that said at least one crimp structure is inwardly concave.

2. The method as defined in claim 1, wherein:

said step of impressing upon the printed product said product break structure entails impressing said product break structure only in the region of said predetermined end of said predetermined folded edge.

* * * * *